US006350001B1

(12) United States Patent
Chu

(10) Patent No.: US 6,350,001 B1
(45) Date of Patent: Feb. 26, 2002

(54) SLIDING TRACK ASSEMBLY FOR DRAWER

(75) Inventor: Leo Chu, Chungho (TW)

(73) Assignee: Dynaslide Corporation, Taipei Hsien (TW)

( * ) Notice: Subject to any disclaimer, the term of this patent is extended or adjusted under 35 U.S.C. 154(b) by 0 days.

(21) Appl. No.: 09/850,097

(22) Filed: May 8, 2001

(51) Int. Cl.[7] ..... A47B 88/00

(52) U.S. Cl. ..... 312/334.44; 312/334.47; 312/334.11

(58) Field of Search ..... 312/334.44, 334.46, 312/334.47, 330.1, 333, 334.1, 334.7, 334.8, 334.11, 334.17; 384/18, 21, 22

(56) References Cited

U.S. PATENT DOCUMENTS 4,549,773 A * 10/1985 Papp et al. ..... 312/334.47 X
5,551,775 A * 9/1996 Parvin ..... 312/334.11
5,757,109 A * 5/1998 Parvin ..... 312/334.11

FOREIGN PATENT DOCUMENTS

DE 2707365 * 8/1978 ..... 312/334.44

* cited by examiner

*Primary Examiner*—James O. Hansen
(74) *Attorney, Agent, or Firm*—Varndell & Varndell, PLLC

(57) ABSTRACT

A sliding track assembly includes an outer rail, an intermediate rail, an inner rail, a stop member, a first sliding bearing, a second sliding bearing, and a locating plate, wherein the inner rail has a raised portion adapted to engage the stop member for enabling the intermediate rail to be moved with the inner rail outwards when pulling a drawer out of a desk; the stop member has a supporting rib bridging a sliding slot of the intermediate rail to support the stop member on the intermediate rail in position when the stop member engages a retaining block of the outer rail; the intermediate rail has two retaining flanges abutting two sides of a curved positioning portion of the spring to hold the spring in place.

2 Claims, 17 Drawing Sheets

SLIDING TRACK ASSEMBLY FOR DRAWER

BACKGROUND AND SUMMARY OF THE INVENTION

The present invention relates to a sliding track assembly for a drawer and, more particularly, to a durable sliding track assembly, which prevents interference of the parts with one another when moving the drawer in or out of a desk, and has means to support the parts in position.

A regular two-step sliding track assembly for a drawer, as shown in FIGS. from 1 through 3, is generally comprised of an inner rail 91, an intermediate rail 92, and an outer rail 93. When pulling the drawer outwards, the inner rail 91 is moved with the drawer out of the intermediate rail 92 at the initial stage as shown in FIG. 2, and then the intermediate rail 92 is pulled out of the outer rail 93 as shown in FIG. 3. Because the inner rail 91 bears the whole weight of the load when pulling the drawer out of the desk, the coupling area between the inner rail 91 and the intermediate rail 92 tends to be damaged.

FIGS. from 4 through 9 show another structure of prior art sliding track assembly. According to this design, the inner rail 94 and the intermediate rail 95 commonly bear the weight of the load at the initial stage when pulling the drawer out of the desk. However, when pulling the inner rail 94 outwards, the pressing force of the stop member 97 against one sidewall 941 of the inner rail 94 tends to be overcome by the pulling force employed to the inner rail 94, thereby causing the inner rail 94 to slip on the intermediate rail 95. In this case, the intermediate rail 95 cannot be simultaneously moved with the inner rail 94 out of the outer rail 96. Because the stop member 97 has a fixed end pivoted to the inner rail 94 by a pivot 98 and a downward protruding plate 971 extended from the free end thereof and stopped against a retaining block (not shown) of the outer rail 96, the stop member 97 tends to be forced to curve upwards upon inward movement of the intermediate rail 95. Frequently curving the stop member 97 may loosen the stop member 97. Furthermore, the spring 99 which is installed in the intermediate rail 95 to support the stop member 97, has only one end 991 stopped against a stop flange 942 of the intermediate rail 95, it tends to be forced out of position when moving the drawer in or out of the desk.

The present invention has been accomplished to provide a sliding track assembly for drawer, which eliminates the drawbacks of the aforesaid prior art designs. According to one aspect of the present invention, the sliding track assembly comprises an outer rail fixedly mounted inside a desk, an intermediate rail carried on a first sliding bearing and moved in and out of the outer rail, an inner rail carried on a second sliding bearing and moved with a drawer in and out of the intermediate rail, a stop member mounted in a sliding slot on the intermediate rail and forced by the spring on the intermediate rail to limit forward movement of the inner rail relative to the intermediate rail, a first sliding bearing coupled between the inner rail and the intermediate rail, a second sliding bearing coupled between the intermediate rail and the outer rail, and a locating plate fixedly fastened to the inner rail at one end to limit forward movement of the inner rail relative to the intermediate rail. According to another aspect of the present invention, the inner rail has a raised portion formed on a front side thereof to contact an upward side flange of the stop member when pulling the drawer out of the desk, keeping the intermediate rail to be moved with the inner rail and the drawer, so that the inner rail and the intermediate rail concomitantly bear the movement of the drawer during the first step. According to still another aspect of the present invention, the intermediate rail, the second sliding bearing, the stop member, the first sliding bearing, and the locating plate are moved in the same direction without causing an interference when pulling the inner rail with the drawer out of the intermediate rail or pushing the drawer back to the inside of the desk. According to still another aspect of the present invention, when pressing the free end of the locating plate, the inner rail is disengaged from a positioning block of the intermediate rail, and the inner rail can then be removed with the drawer from the intermediate rail. According to still another aspect of the present invention, the stop member has a supporting rib bridging the sliding slot of the intermediate rail to positively support the stop member on the intermediate rail against the stop portion of the retaining block of the outer rail. According to still another aspect of the present invention, the intermediate rail has integrated retaining flanges abutting two sides of a curved positioning portion of the spring to hold the spring in place.

DETAILED DESCRIPTION OF THE PREFERRED EMBODIMENT

Figure 1:
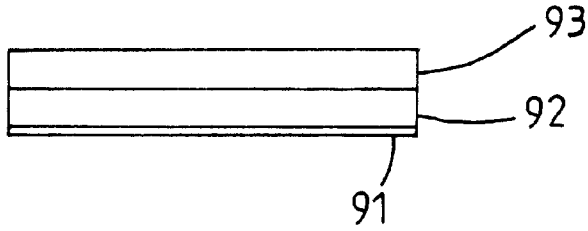
Fig. 1 PRIOR ART
FIG. 1 is a side plain view of a sliding track assembly according to the prior art.
Figure 2:
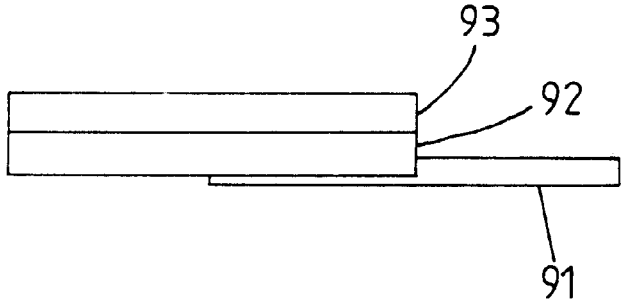
Fig. 2 PRIOR ART
FIG. 2 is similar to FIG. 1 but showing the inner rail pulled out of the intermediate rail.
Figure 3:
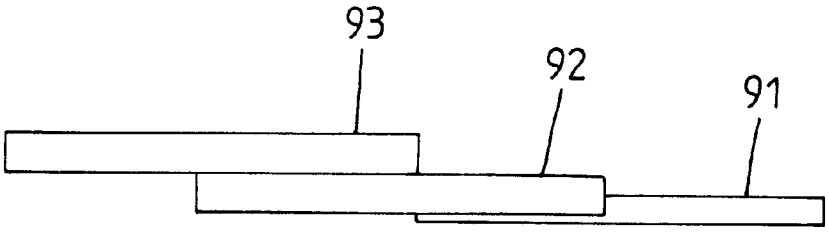
Fig. 3 PRIOR ART
FIG. 3 is similar to FIG. 2 but showing the intermediate rail pulled out of the outer rail.
Figure 4:
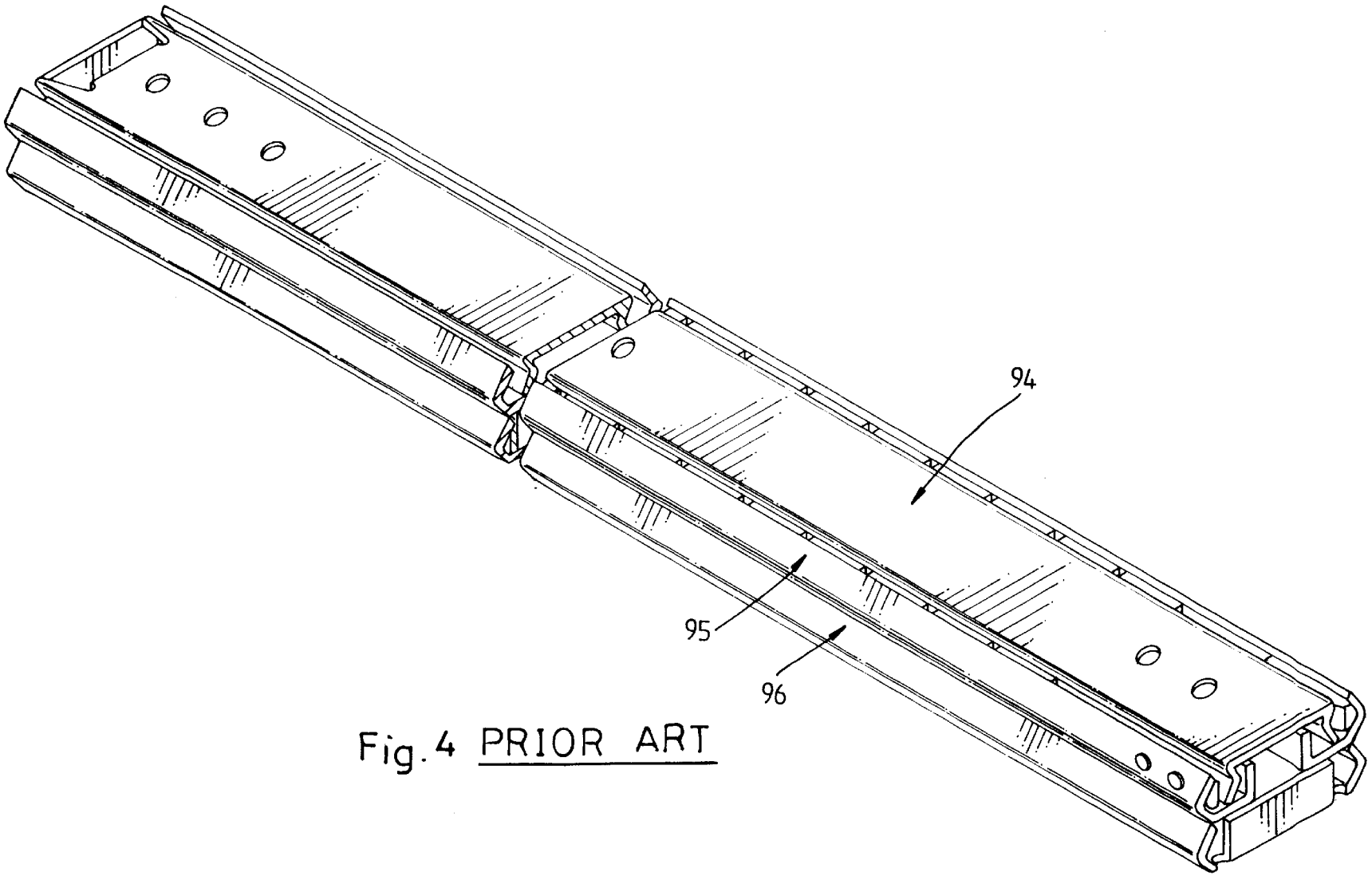
Fig. 4 PRIOR ART
FIG. 4 is an elevational view of another structure of sliding track assembly according to the prior art.
Figure 5:
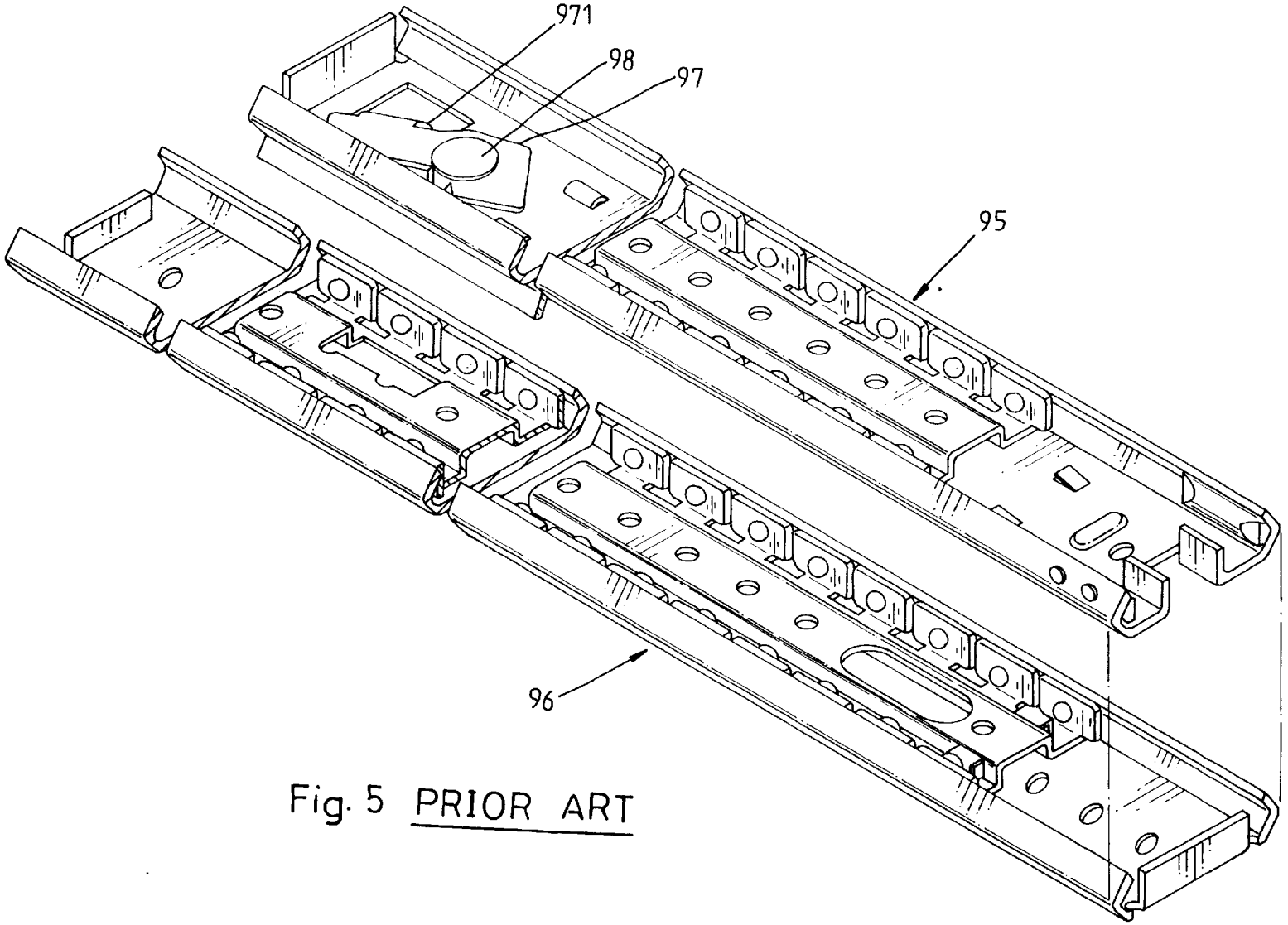
Fig. 5 PRIOR ART
FIG. 5 is an exploded view of the sliding track assembly shown in FIG. 4.
Figures 6, 7:
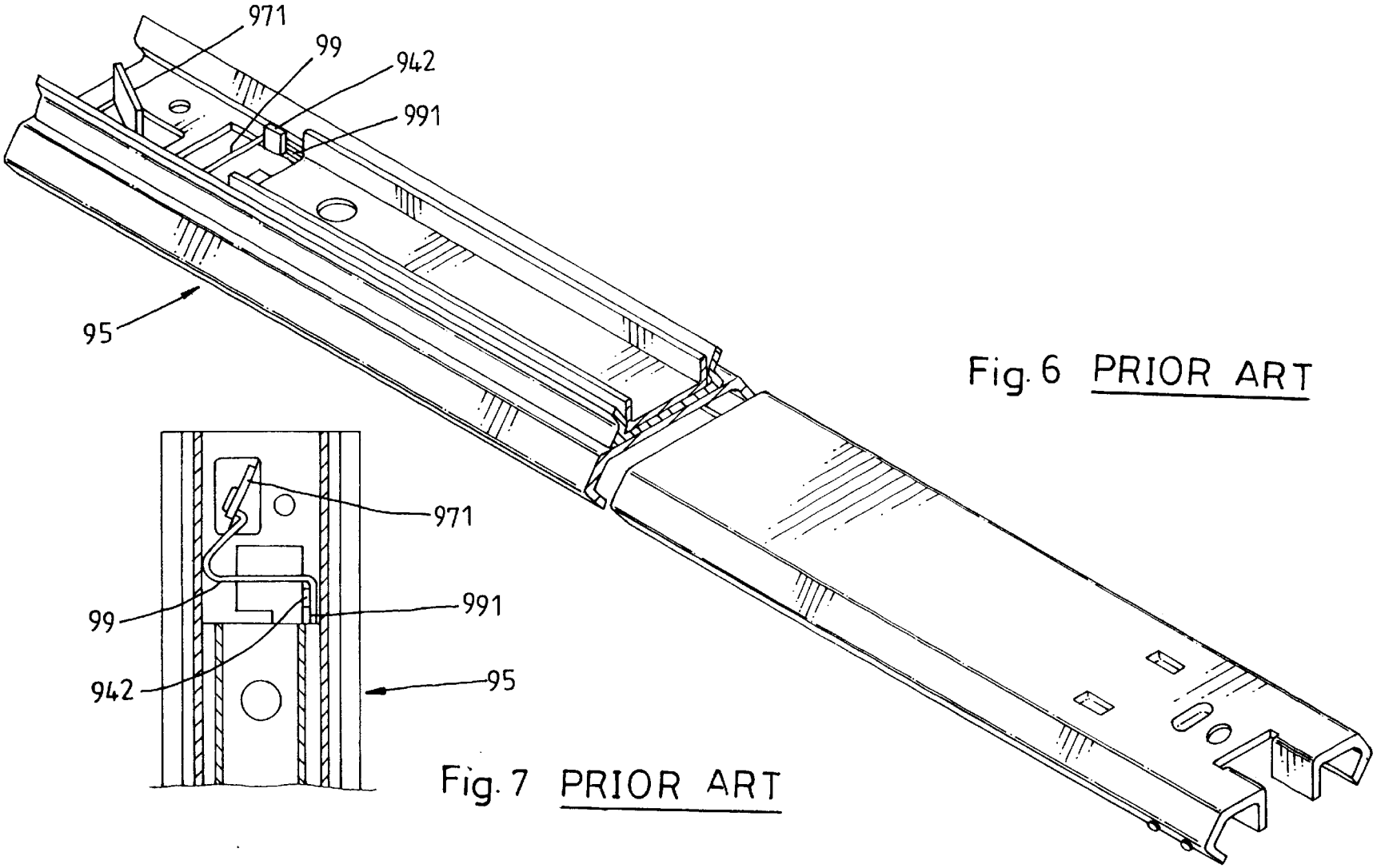
Fig. 6 PRIOR ART
Fig. 7 PRIOR ART
FIG. 6 is a perspective backside view of the sliding track assembly shown in FIG. 4.
FIG. 7 is a sectional plain view of a part of the sliding track assembly shown in FIG. 4.
Figure 9:
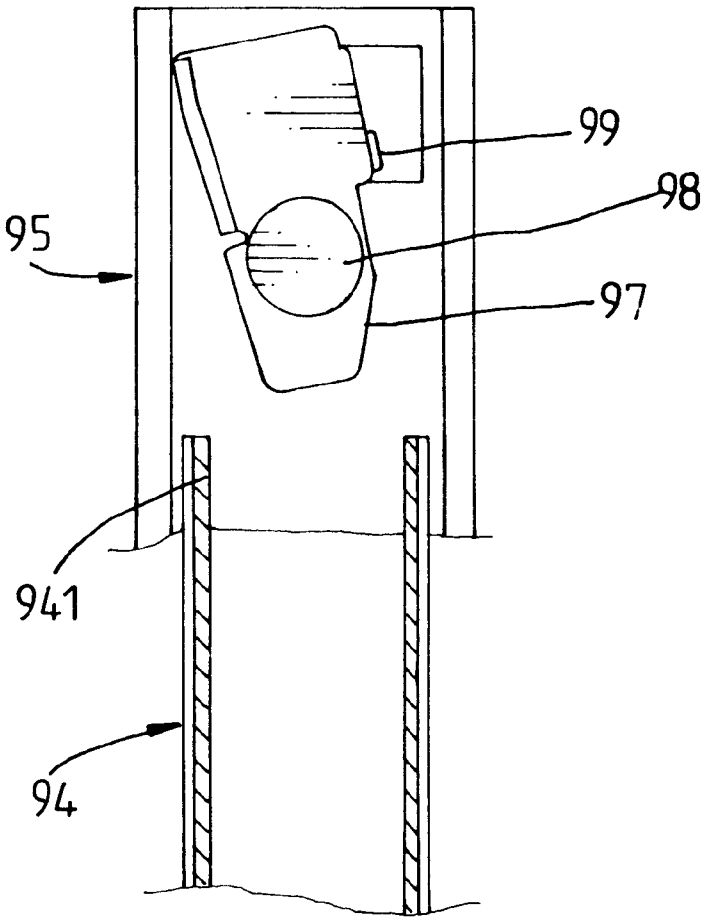
Fig. 9 PRIOR ART
FIG. 9 is similar to FIG. 8 but showing the inner rail extended out of the intermediate rail, the stop member biased.
Figure 8:
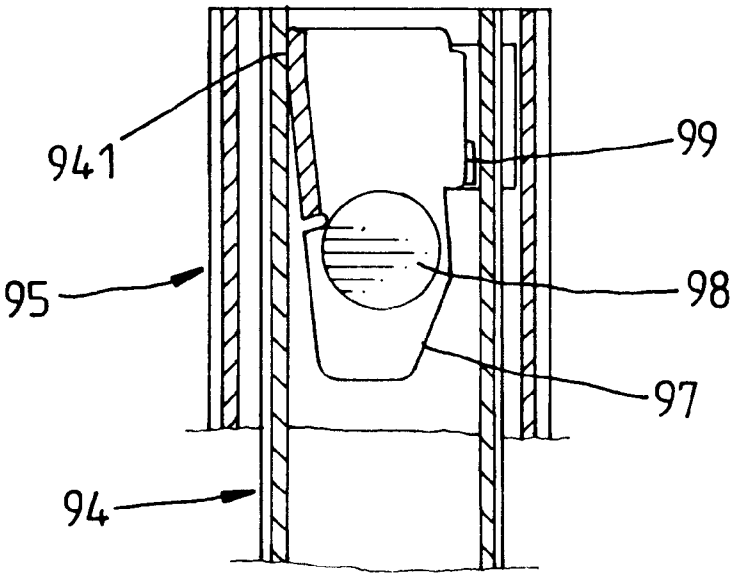
Fig. 8 PRIOR ART
FIG. 8 is a sectional plain view of another part of the sliding track assembly shown in FIG. 4.
Figure 10:
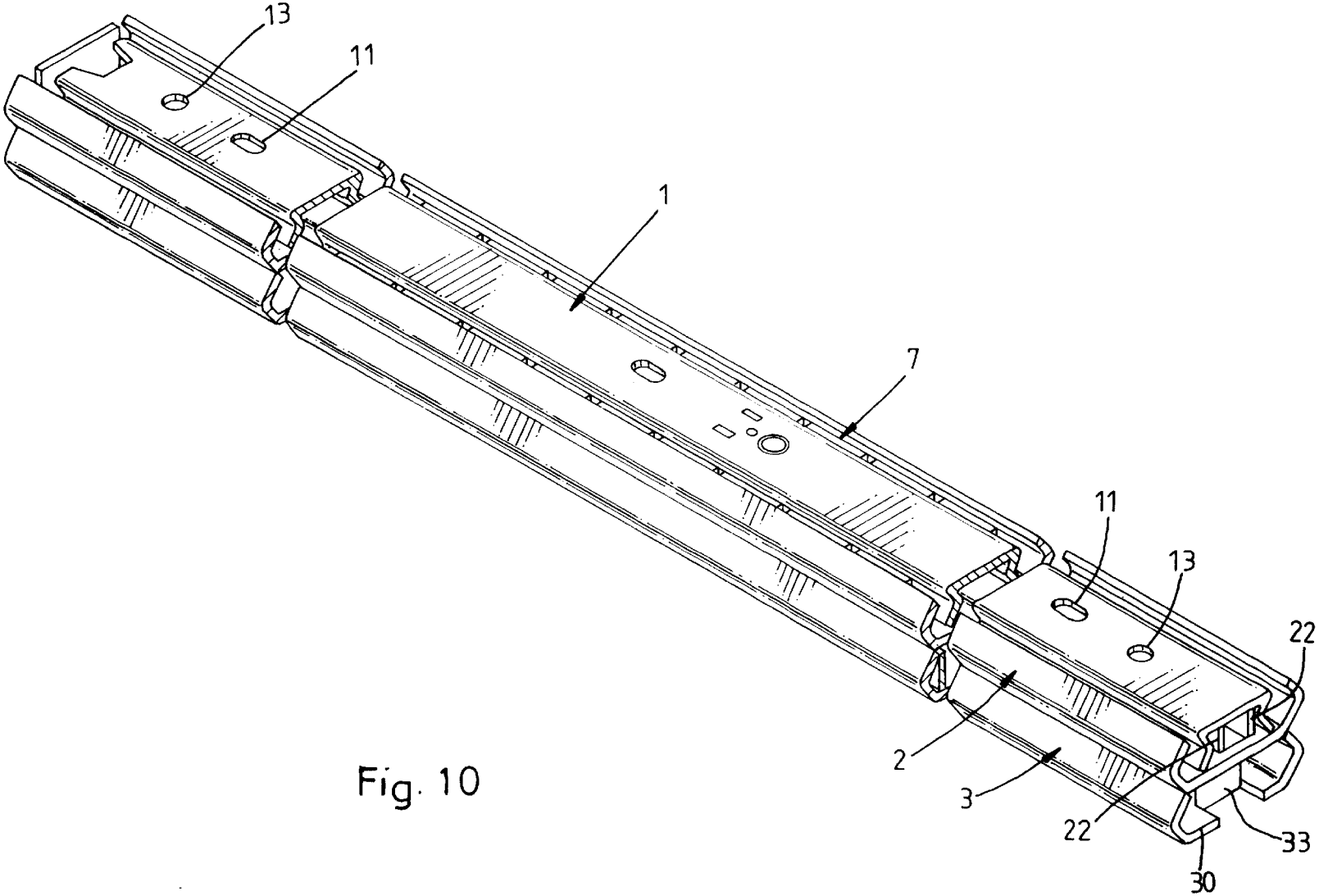
FIG. 10 is a perspective view of a sliding track assembly according to a first embodiment of the present invention.
Figure 11:
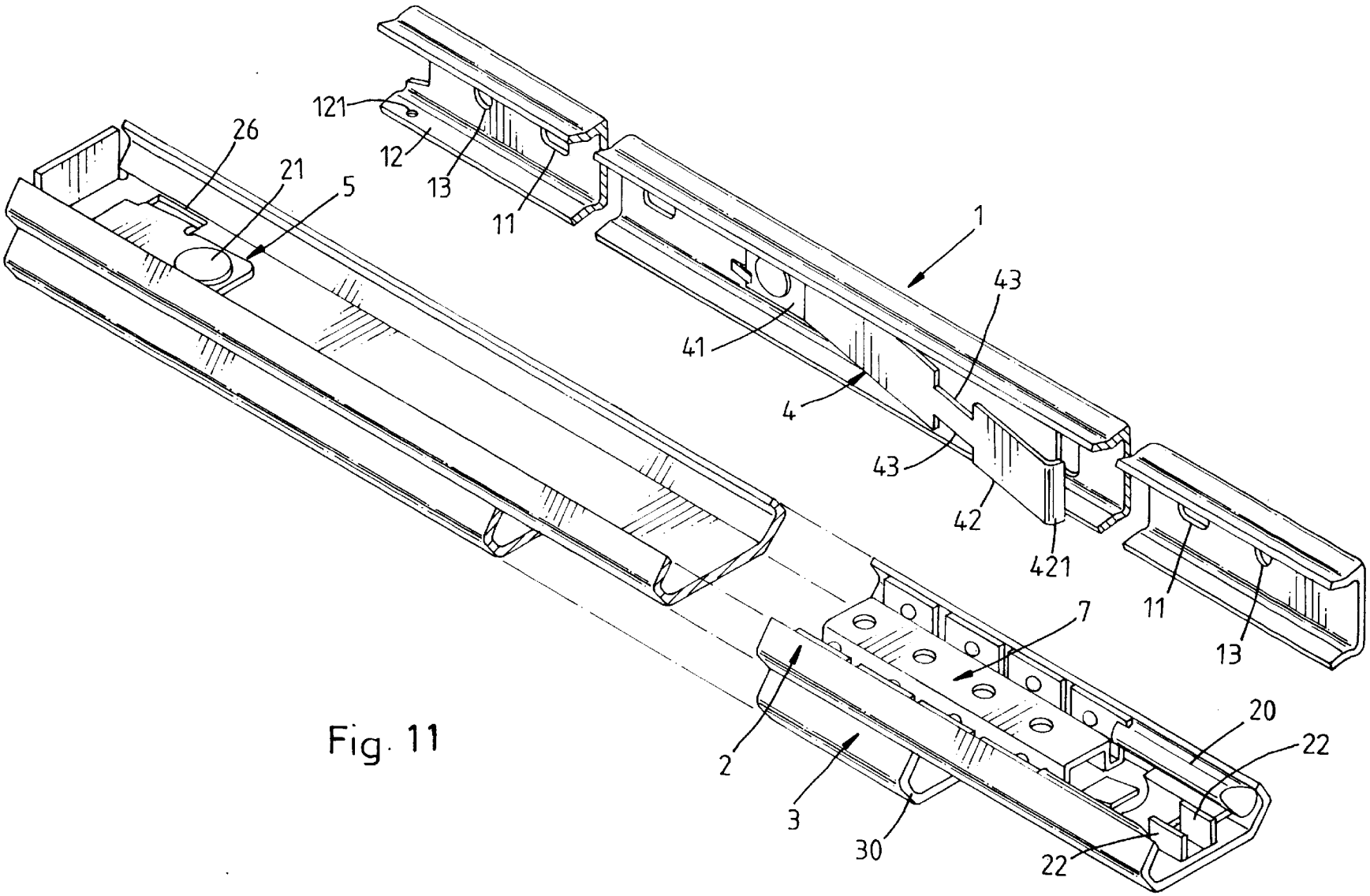
FIG. 11 is an exploded view of the sliding track assembly according to the first embodiment of the present invention.
Figure 12:
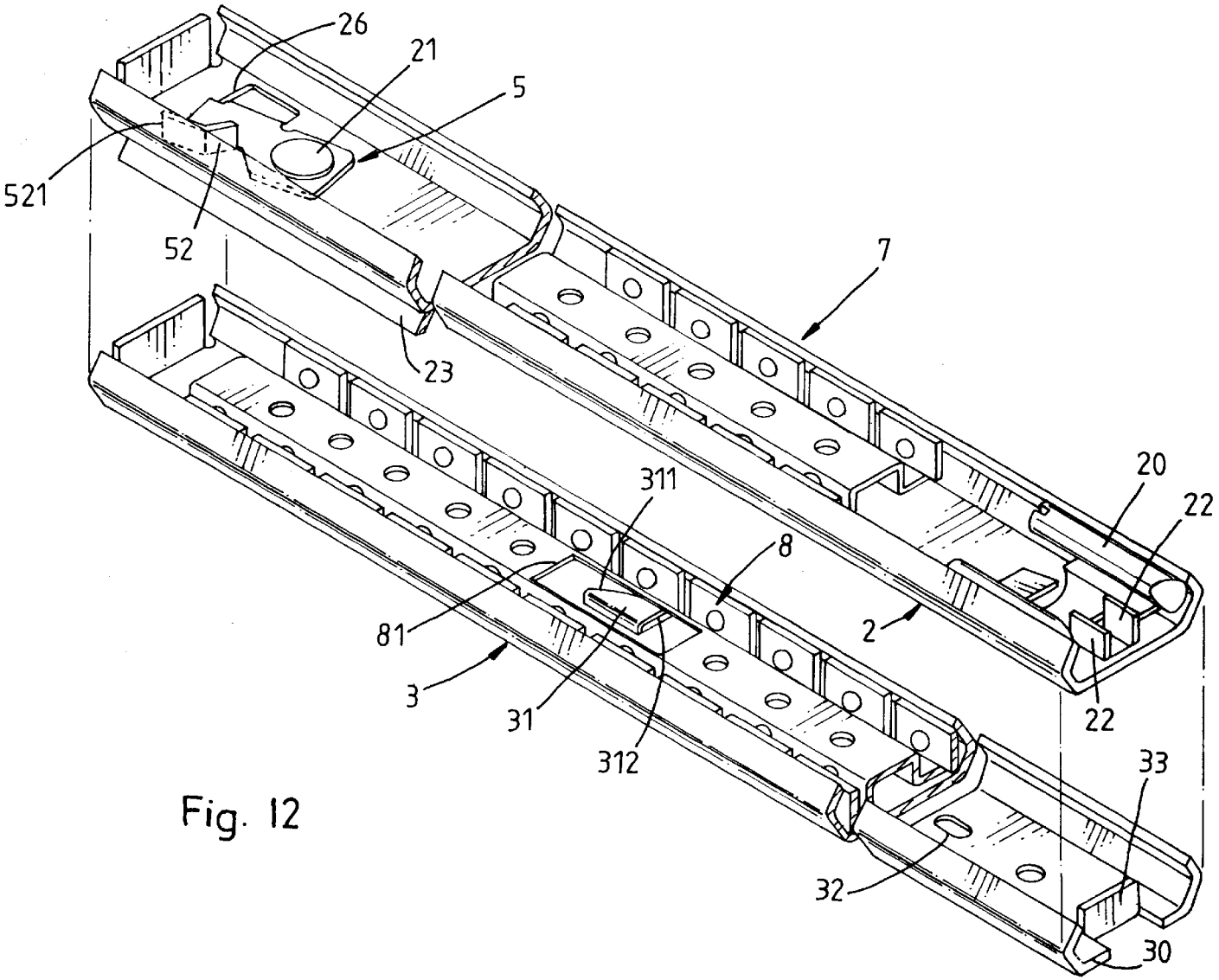
FIG. 12 is another exploded view of the sliding track assembly according to the first embodiment of the present invention.

Referring to FIGS. from 10 through 21, a sliding track assembly in accordance with the present invention comprises a locating plate 4, a stop member 5, a spring 6, an outer rail 3, an intermediate rail 2, an inner rail 1, a first sliding bearing 7 coupled between the inner rail 1 and the intermediate rail 2, and a second sliding bearing 8 coupled between the intermediate rail 2 and the outer rail 3. The outer rail 3 is fixedly fastened to the inside wall of, for example, a desk (not shown). The inner rail 1 is fixedly fastened to one lateral sidewall of a drawer (not shown). The locating plate 4 is injection-molded from plastic, and fixedly fastened to the inner rail 1 near its rear end. The intermediate rail 2 is coupled between the outer rail 3 and the inner rail 1, and moved in and out of the outer rail 3.

The locating plate 4 is a spring plate having one end 41 fixedly fastened to a middle part of the inner rail 1, an opposite end 42 extending out of the inner rail 1 and suspending in the open air and terminating in an inwardly extended guide face 421. The inner rail comprises a plurality of mounting holes 11 and 13 for fastening to the drawer (not shown) by fastening elements, (not shown) the location plate 4 comprise the two retaining notches 43 bilaterally disposed on the middle thereof.

A rivet 21 is fastened to one end of the intermediate rail 2 to secure the stop member 5 and the spring 6 to the intermediate rail 2. The stop member 5 comprises a downward protruding block 51 inserted through a sliding slot 26 of the 10 intermediate rail 2, an upward side flange 52. The intermediate rail 2 comprises a positioning block 20 at its one end remote from the stop member 5. The positioning block 20 comprises two positioning flanges 22 adapted to engage the retaining notches 43 of the locating plate 4 on the inner rail 1. The intermediate rail 2 has a back track 23 fixedly fastened to the back sidewall thereof (see FIG. 15). The aforesaid spring 6 has a first end 61 fixed against the downward protruding block 51 of the stop member 5 (see FIGS. 15 and 16), and a second end 62 fixed against one sidewall 231 of the track 23 (see FIG. 16). The outer rail 3 comprises a retaining block 31 on the middle thereof, and a plurality of mounting holes 32 for fastening to the desk (not shown) by fastening elements (not shown). The retaining block 31 comprises a smoothly arched guide portion 311, and a stop portion 312 adapted to stop the downward protruding block 51 of the stop member 5. The second sliding beating 8 has a longitudinal opening 81, which receives the retaining block 31.

When pulling the drawer outwards from the desk, the inner rail 1 is moved with the drawer. At this time, the spring 6 imparts a pressure to the stop member 5, forcing the upward side flange 52 against one sidewall 12 of the inner rail 1, and therefore the intermediate rail 2 is moved with the inner rail 1. When moving the intermediate rail 2 outwards to a certain extent, the first sliding bearing 7 will be stopped by the upright front stop flange 33 of the outer rail 3, allowing the inner rail 1 to be continuously pulled outwards. When disconnecting the sidewall 12 of the inner rail 1 from the front side 521 of the upward side flange 52 of the stop member 5, the stop member 5 is forced by the spring 6 to move the downward protruding block 51 into engagement with the stop portion 312 of the retaining block 31 to stop outward movement of the intermediate rail 2, allowing the inner rail 1 to be continuously pulled outwards with the drawer until engagement of the retaining notches 43 of the locating plate 4 with the positioning flanges 22 of the positioning block 20. On the contrary, when pushing the drawer back to the inside of the desk, the locating plate 4 is pressed and disengaged from the positioning flanges 22 of the positioning block 20 for enabling the inner rail 1 to be moved backwards with the drawer. Continuously moving the inner rail 1 backwards causes the sidewall 12 of the inner rail 1 to force the stop member 5 away from the retaining block 31 of the outer rail 3 for enabling the intermediate rail 2 to be moved with the inner rail 1 backwards to the inside of the desk.

Figure 18:
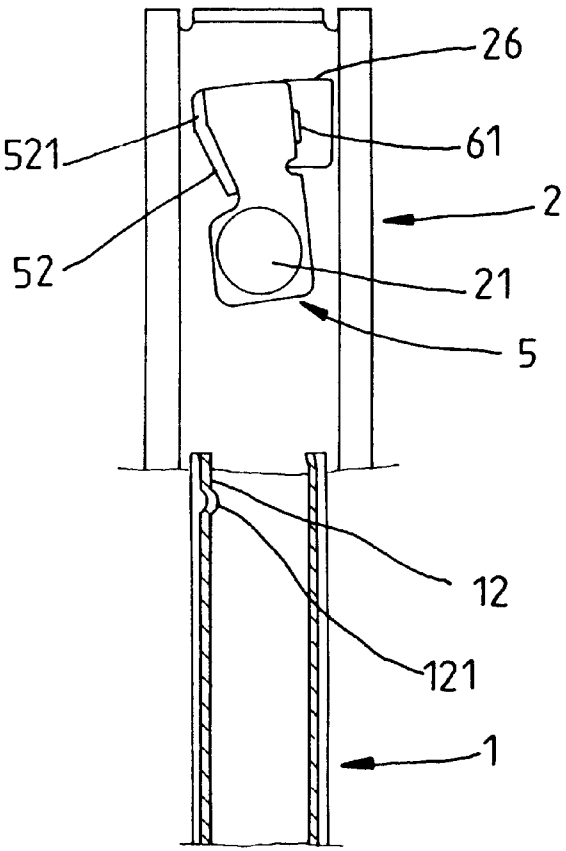
FIG. 18 is a sectional plain view of a part of the sliding track assembly according to the first embodiment of the present invention, showing the inner rail extended out of the intermediate rail.
Figure 17:
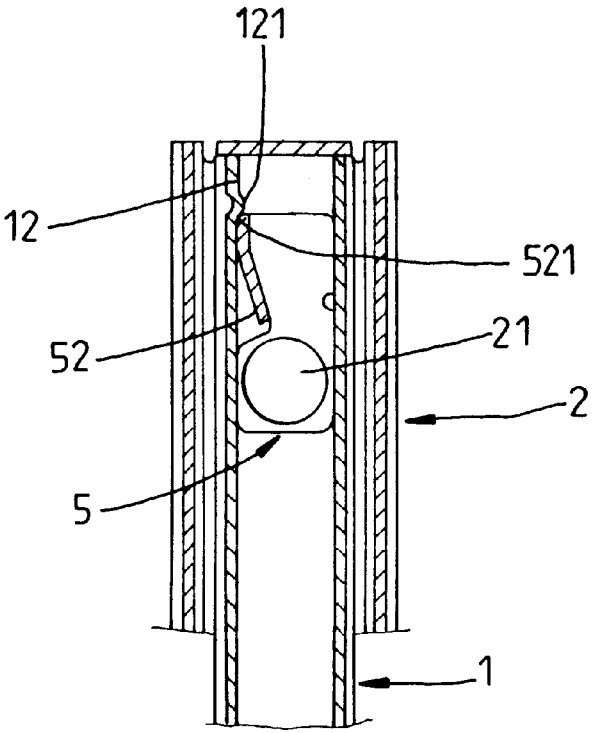
FIG. 17 is a sectional view showing the front side of the upward side flange of the stop member stopped against the raised portion of the intermediate rail according to the first embodiment of the present invention.
Figure 19:
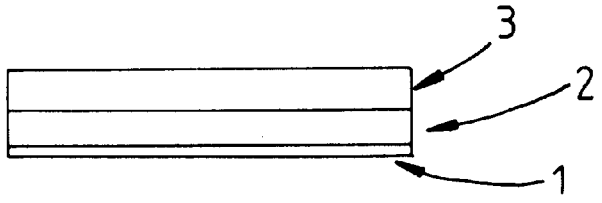
FIG. 19 is a side plain view of the present invention, showing the inner rail received in the intermediate rail within the outer rail.
Figure 20:
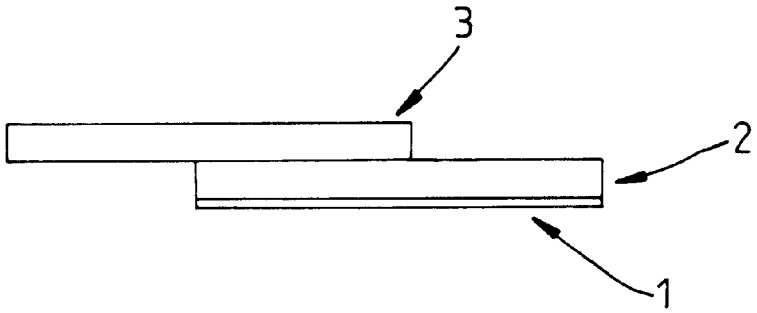
FIG. 20 is another side plain view of the present invention, showing the inner rail received in the intermediate rail, the intermediate rail extended out of the outer rail.
Figure 21:
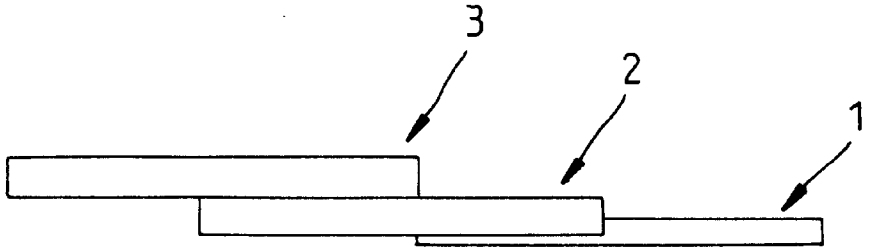
FIG. 21 is still another side plain view of the present invention, showing the intermediate rail extended out of the outer rail, the inner rail extended out of the intermediate rail.
Figure 22:
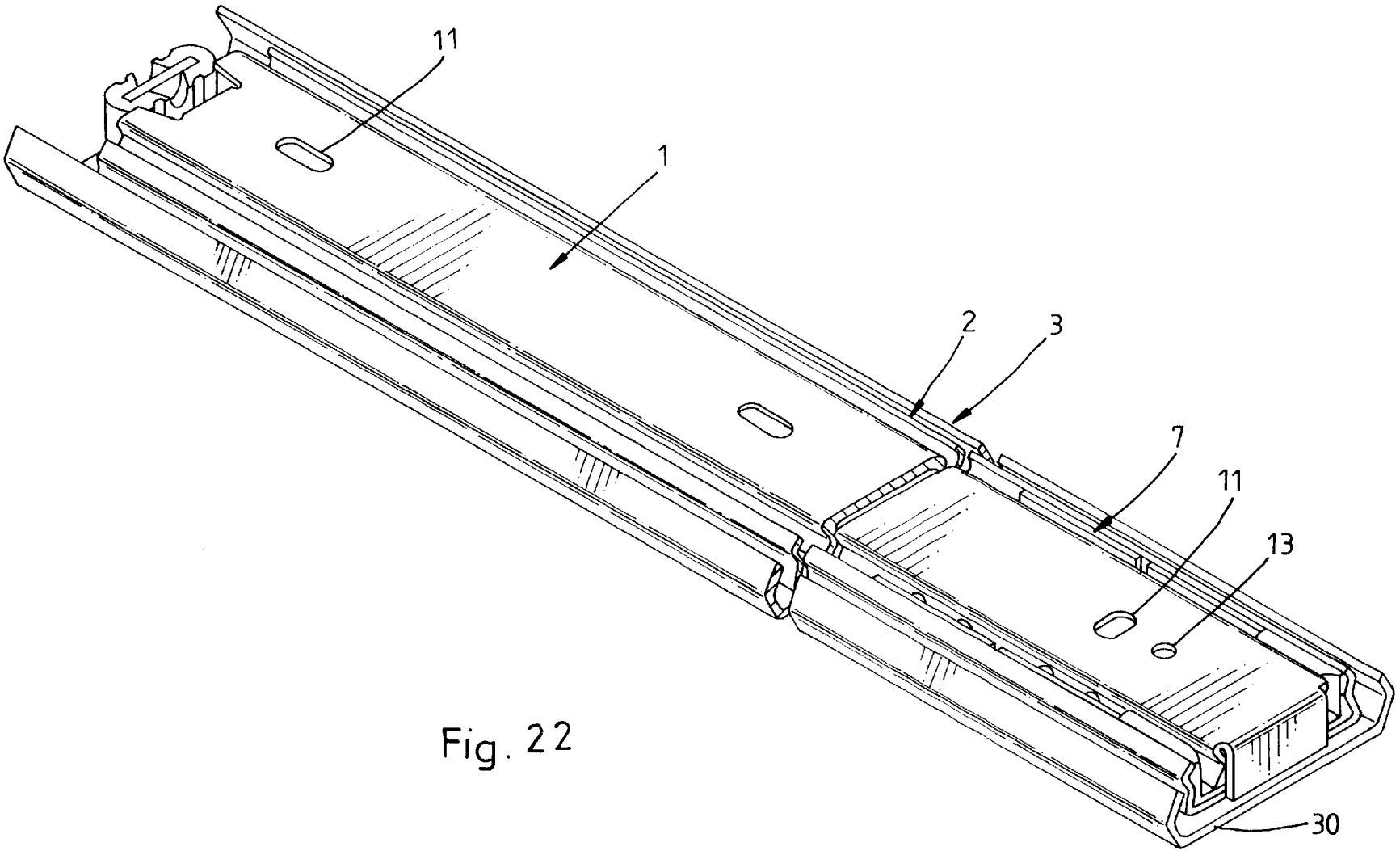
FIG. 22 is a perspective view of a sliding track assembly according to a second embodiment of the present invention.
Figure 23:
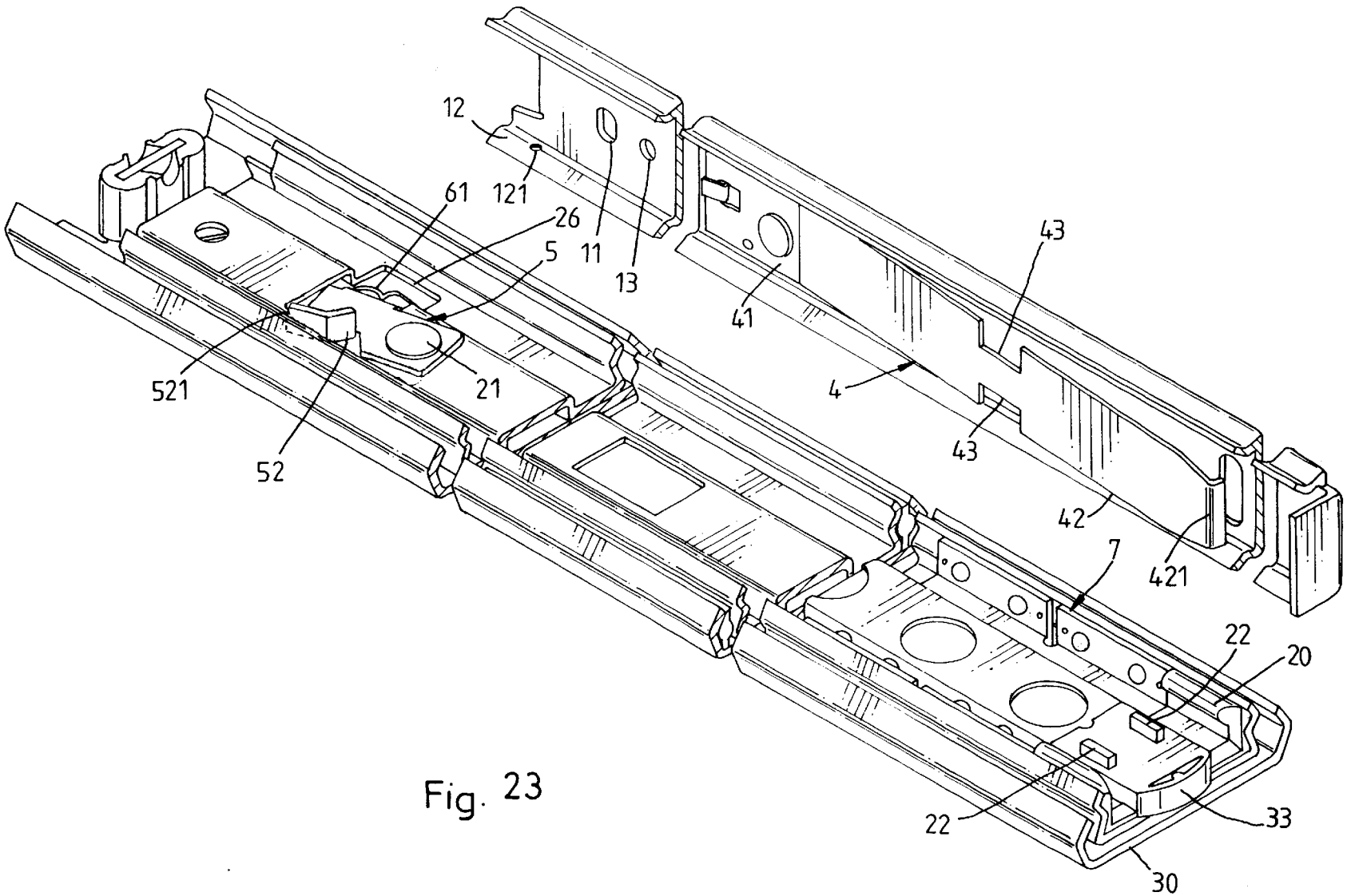
FIG. 23 is an exploded view of the sliding track assembly according to the second embodiment of the present invention.
Figure 24:
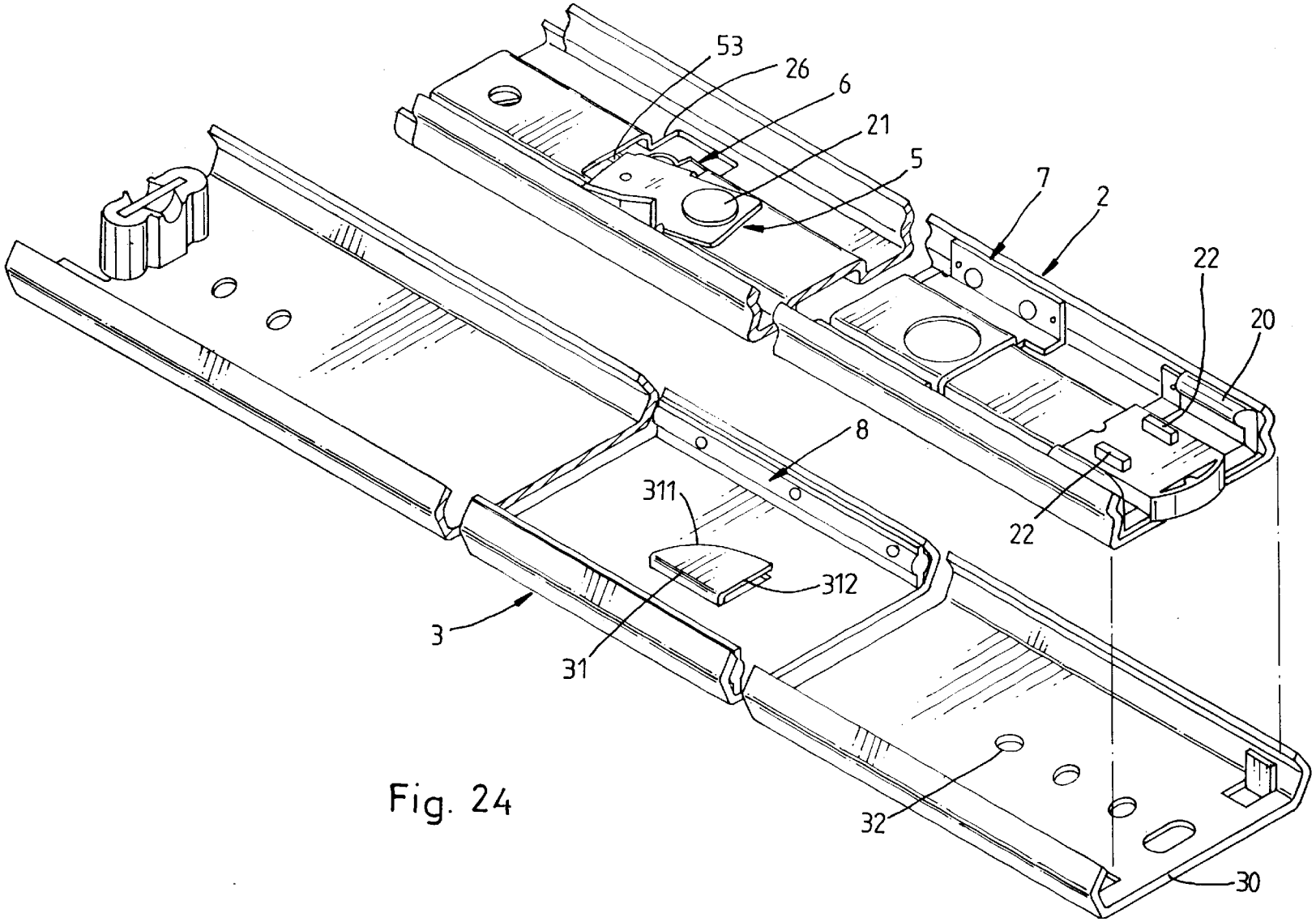
FIG. 24 is another exploded view of the sliding track assembly according to the second embodiment of the present invention.

The main characteristics of the present invention are outlined hereinafter. The sidewall 12 of the inner rail 1 has a raised portion 121 adapted to engage the front side 521 of the upward side flange 52 of the stop member 5 (see FIG. 17), for enabling the intermediate rail 2 to be positively carried with the inner rail 1 outwards. After engagement of the raised portion 121 with the front side 521 of the upward side flange 52 of the stop member 5 during forward movement of the inner rail 1 with the drawer, the user employs more outward pulling force to the drawer to overcome the engagement force between the raised portion 121 and the upward side flange 52 of the stop member 5 and to force the raised portion 121 over the upward side flange 52 of the stop member 5 (see FIG. 18), so as to pull the inner rail 1 out of the intermediate rail 2. As indicated above, the drawer is pulled out of the desk through two steps, that is, the first step where the inner rail 1 and the intermediate rail 2 are moved with the drawer out of the outer rail 3, and the second step where the inner rail 1 is moved with the drawer out of the intermediate rail 2. Because the inner rail 1 and the intermediate rail 2 support the drawer during the first step, the sliding track assembly is durable in use. When pushing the drawer back to the inside of the desk, the inner rail 1, the intermediate rail 2, the second sliding bearing 8, the stop member 5, the first sliding bearing 7, and the locating plate 4 are moved in same direction without causing an interference, and therefore the drawer can be smoothly moved back to the inside of the desk.

The retaining block 31 protrudes over the bottom wall 30 of the outer rail 3. As indicated above, the retaining block 31 has a smoothly arched guide portion 311 adapted to guide the downward protruding block 51 of the stop member 5, and a stop portion 312 adapted to stop the downward protruding block 51 of the stop member 5.

Figure 14:
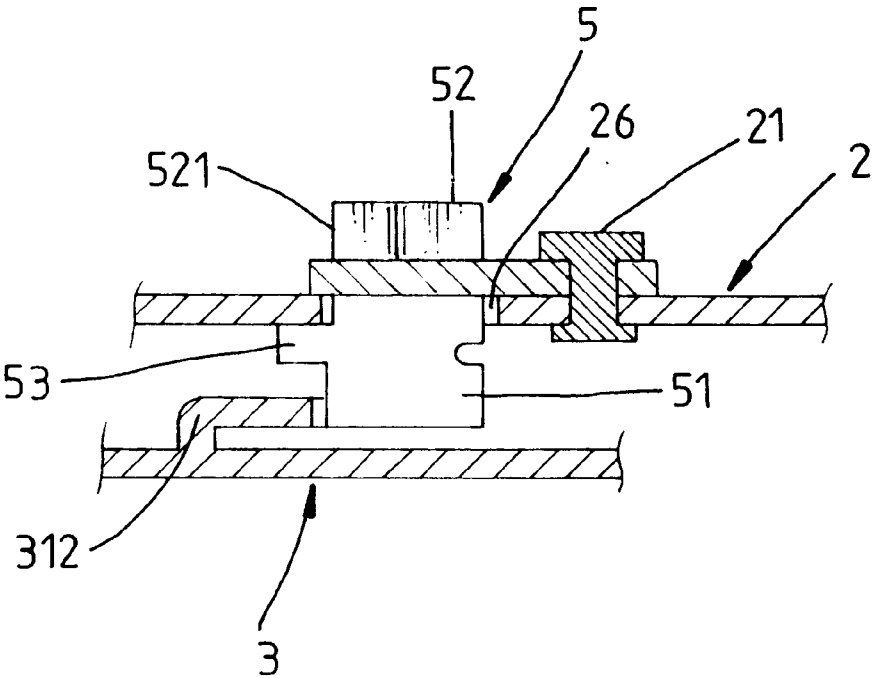
FIG. 14 is a sectional view of a part of the present invention, showing the stop member installed in the intermediate rail, the downward protruding retaining block of the stop member stopped against the retaining block of the outer rail.
Figure 13:
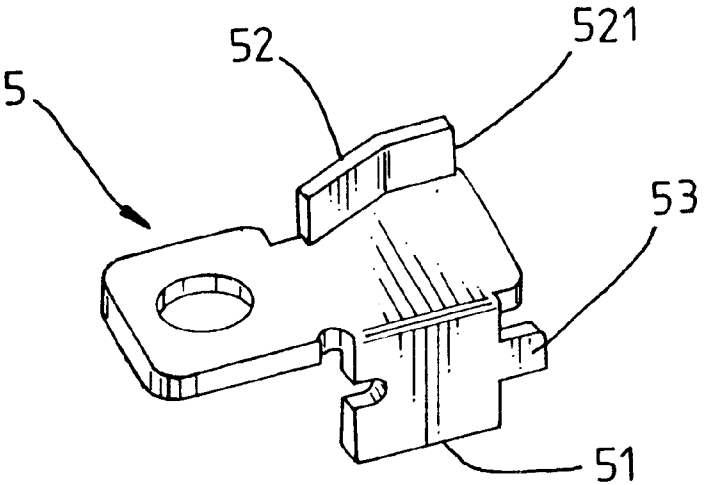
FIG. 13 is a perspective view of the stop member for the sliding track assembly according to the first embodiment of the present invention.

Referring to FIG. 13, the downward protruding block 51 of the stop member 5 comprises a supporting rib 53 bridging the sliding slot 26 of the intermediate rail 2. The supporting rib 53 positively supports the stop member 5 on the intermediate rail 2 when the downward protruding block 51 of the stop member 5 engages the stop portion 312 of the retaining block 31. When pushing the intermediate rail 2 backwards into the outer rail 3 after the stop member 5 has been stopped against the stop portion 312 of the retaining block 31, the supporting rib 53 prevents the stop member 5 from being curved upwards (see FIG. 14).

Figures 15, 16:
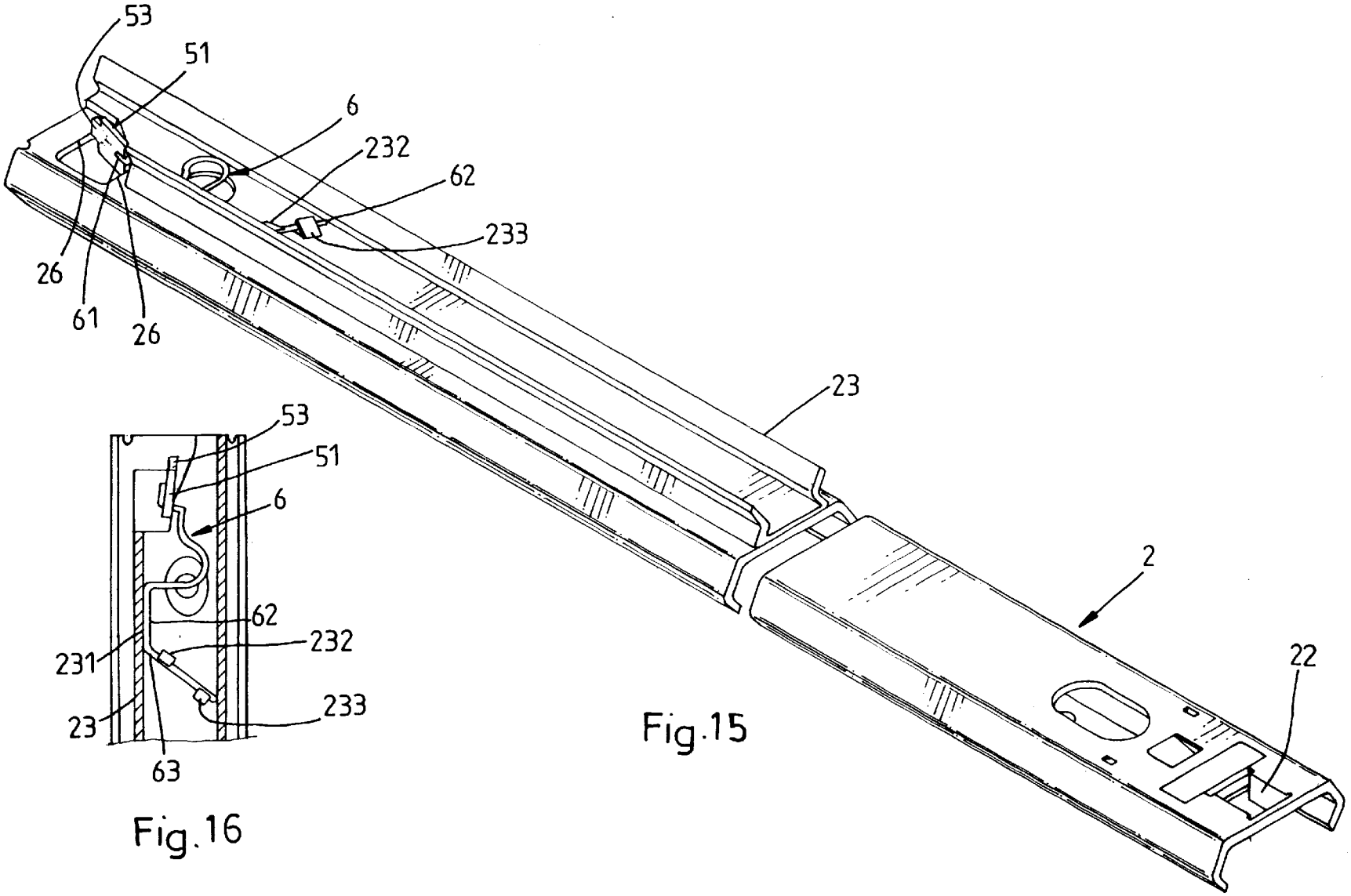
FIG. 15 is an oblique backside view of the intermediate rail for the sliding track assembly according to the first embodiment of the present invention.
FIG. 16 is a sectional plain view of a part of FIG. 15.

Referring to FIGS. 15 and 16, the spring 6 has a curved positioning portion 63 extended from the second end 62, and the intermediate rail 2 comprises two retaining flanges 232 and 233 abutting two sides of the curved positioning portion 63 to hold the spring 6 in place.

Figures 25, 26:
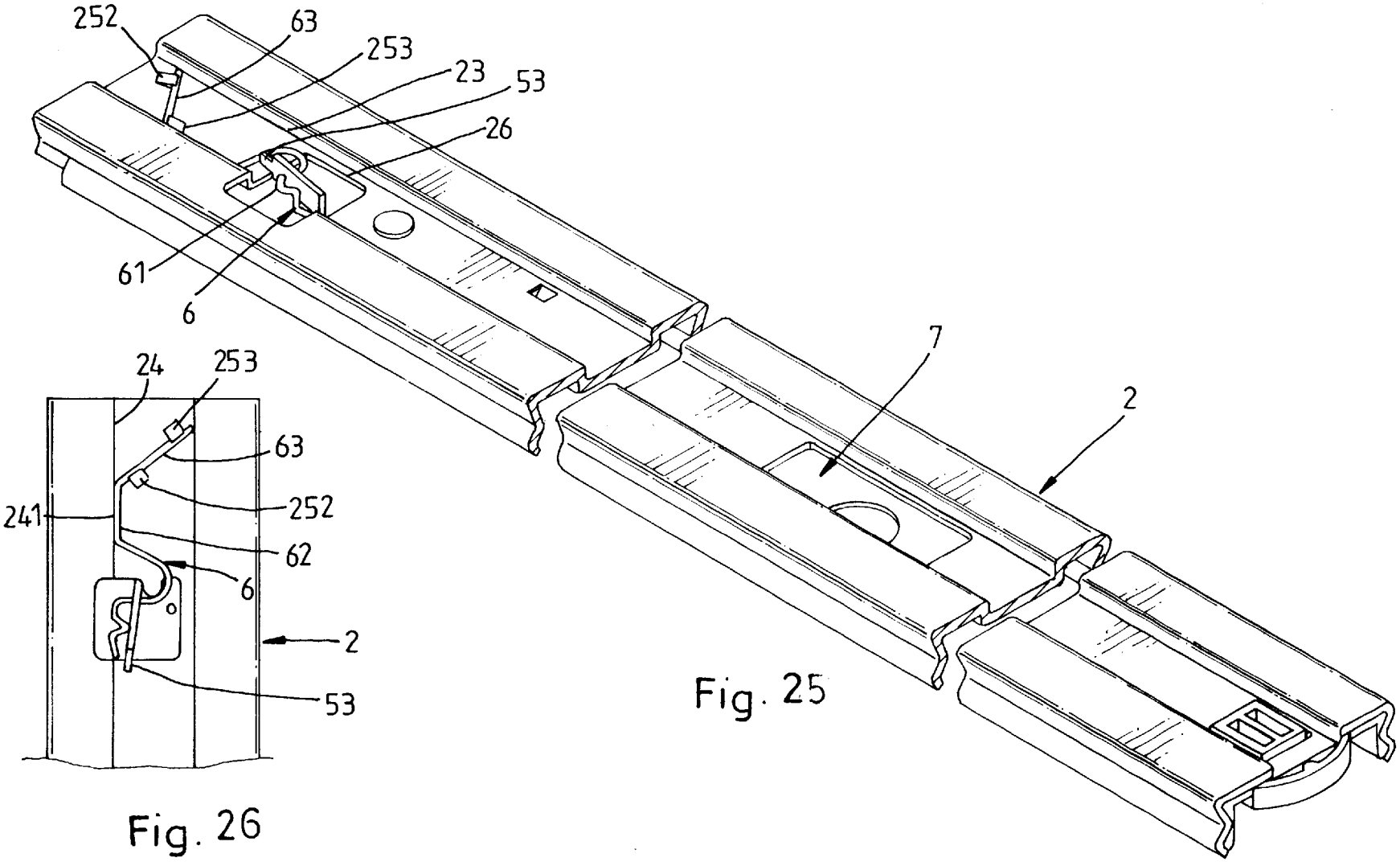
FIG. 25 is a backside view of the intermediate rail according to the second embodiment of the present invention.
FIG. 26 is a plain view of a part of FIG. 25.
Figure 28:
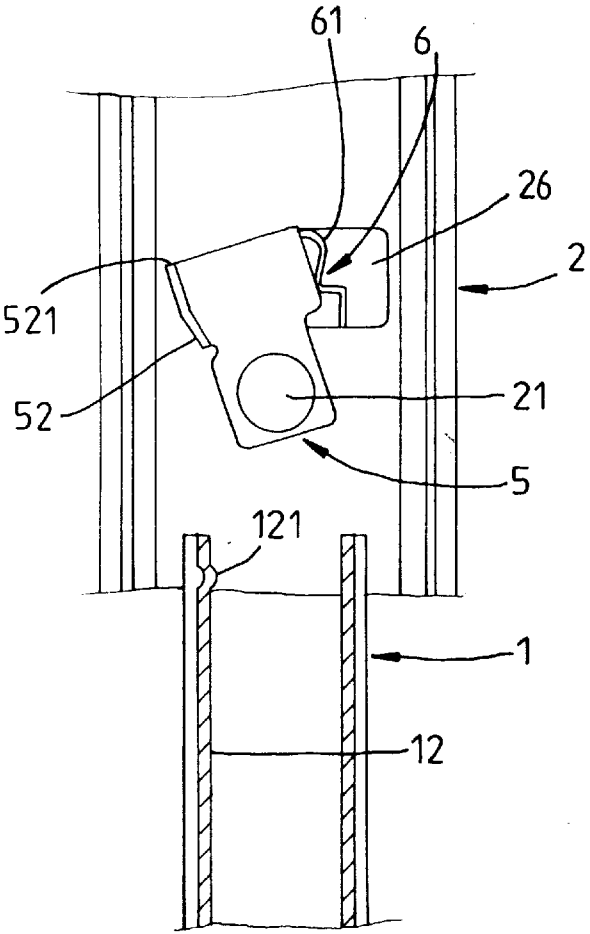
FIG. 28 is a sectional plain view of a part of the sliding track assembly according to the second embodiment of the present invention, showing the inner rail extended out of the intermediate rail.
Figure 27:
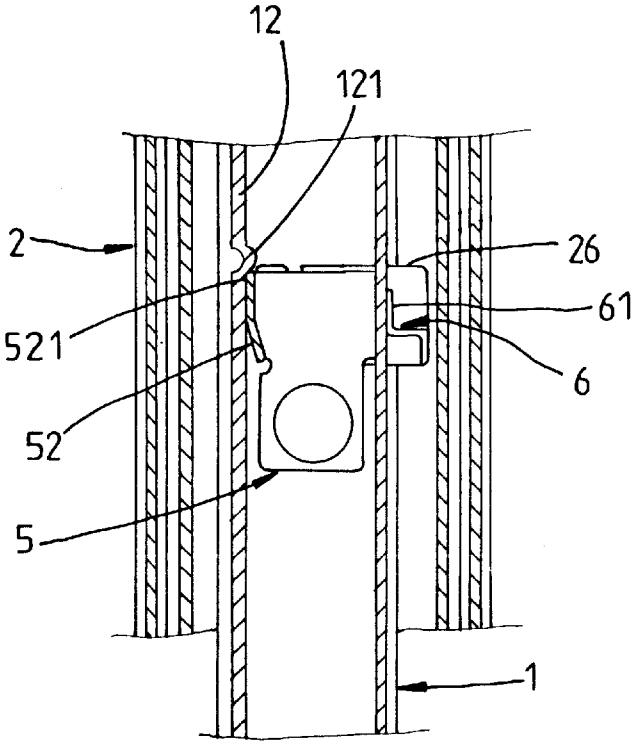
FIG. 27 is a sectional view of a part of the sliding track assembly according to the second embodiment of the present invention, showing the front side of the upward side flange of the stop member stopped against the raised portion of the intermediate rail.

FIGS. from 22 through 28 show an alternate form of the present invention. According to this alternate form, the intermediate rail 2 eliminates the aforesaid back track 23 and is directly coupled to the outer rail 3, keeping the second sliding bearing 8 maintained between the intermediate rail 2 and the outer rail 3. The second end 62 of the spring 6 is fixed at one side edge 241 of a back groove 24 at the backside of the intermediate rail 2 (see FIGS. 25 and 26). The intermediate rail 2 comprises two integrated retaining flanges 252 and 253 abutting two sides of the curved positioning portion 63 of the spring 6 to hold the spring 6 in place.

As indicated above, the sliding track assembly of the present invention achieves the following advantages:

1. When pulling the drawer out of the desk during the first step, the raised portion 121 of the inner rail 1 is stopped at the front side 521 of the upward side flange 52 of the stop member 5, keeping the intermediate rail 2 to be moved with the inner rail 1 and the drawer, so that the inner rail 1 and the intermediate rail 2 concomitantly bear the movement of the drawer during the first step.
2. When pulling the inner rail 1 with the drawer out of the intermediate rail 2 or pushing the drawer back to the inside of the desk, the inner rail 1, the intermediate rail 2, the second sliding bearing 8, the stop member 5, the first sliding bearing 7, and the locating plate 4 are moved in the same direction without causing an interference.
3. When pressing the free end 42 of the locating plate 4 to disengage the retaining notches 43 from the positioning flanges 22 of the positioning block 20, the inner rail 1 can be removed with the drawer from the intermediate rail 2.
4. The supporting rib 53 of the top member 5 bridges the sliding slot 26 of the intermediate rail 2 to positively support the stop member 5 on the intermediate rail 2 against the stop portion 312 of the retaining block 31.
5. The integrated retaining flanges 252 and 253 of the intermediate rail 2 abut two sides of the curved positioning portion 63 of the spring 6 to hold the spring 6 in place, keeping the spring 6 to work effectively.

What is claimed is:

1. A sliding track assembly comprising a stop member, a spring, an outer rail for fastening to an inside wall of a desk, said outer rail having an upright front stop flange at one end, an intermediate rail, an inner rail for fastening to a drawer for enabling said drawer to be moved in and out of said desk, a first sliding bearing coupled between said inner rail and said intermediate rail, a second sliding bearing coupled between said intermediate rail and said outer rail, a locating plate having one end fixedly fastened to said inner rail, said locating plate having a fixed end fixedly fastened to a middle part of said inner rail, a free end extending out of said inner rail and terminating in an inwardly extended guide face, and two retaining notches bilaterally disposed on a middle portion of the locating plate between said fixed end and said free end, said spring fastened with said stop member to said intermediate rail, said intermediate rail having a sliding slot, said stop member comprising a downward protruding block inserted through the sliding slot of said intermediate rail, an upward side flange, a positioning block at one end remote from said stop member, the positioning block of said intermediate rail comprising two positioning flanges adapted to engage the retaining notches of said locating plate of said inner rail, said spring having a first end fixed against the downward protruding block of said stop member and a second end fixed against a part of said intermediate rail, said outer rail comprising a retaining block on a middle thereof; said retaining block comprising a smoothly arched guide portion and a stop portion adapted to stop the downward protruding block of said stop member, said second sliding bearing having a longitudinal opening, which receives said retaining block, said spring forcing the upward side flange of said, stop member against one sidewall of said inner rail for enabling said intermediate rail to be moved wit said inner rail when pulling said drawer out of said desk at an initial stage, said first sliding bearing being stopped by the upright front stop flange of said outer rail for allowing said inner rail to be continuously pulled outwards when pulling said drawer out of said desk , said stop member being forced by said spring to move said downward protruding block into engagement with the stop portion of said retaining block to stop outward movement of said intermediate rail for allowing said inner rail to be continuously pulled outwards with said drawer until engagement of the retaining notches of said locating plate with the positioning flanges of the positioning block, said locating plate being pressed and disengaged from the positioning flanges of said positioning block for enabling said inner rail to be moved backwards with said drawer, and said inner rail forcing said stop member away from the retaining block of said outer rail for enabling said intermediate rail to be moved with said inner rail backwards to an inside of said desk;

wherein said inner rail comprises a raised portion protruded from said one sidewall thereof adapted to engage the upward side flange of said stop member for enabling said intermediate rail to be moved with said inner rail outwards when pulling said drawer out of said desk, said raised portion of said inner rail being moved over the upward side flange of said stop member for enabling said inner rail to be pulled with said drawer out of said intermediate rail when pulling said drawer outwards by force; said inner rail, said intermediate rail, said second sliding bearing, said stop member, said first sliding bearing, and said locating plate are moved in the same direction without causing an interference when pulling said drawer out of said desk or pushing said drawer back into the inside of said desk, said spring has a curved positioning portion extended from one end thereof, and said intermediate rail comprises two retaining flanges abutting two sides of the curved positioning portion of said spring to hold said spring in place.

2. A sliding track assembly comprising a stop member, a spring, an outer rail for fastening to an inside wall of a desk, said outer rail having an upright front stop flange at one end, an intermediate rail, an inner rail for fastening to a drawer for enabling said drawer to be moved in and out of said desk, a first sliding bearing coupled between said inner rail and said intermediate rail, a second sliding bearing coupled between said intermediate rail and said outer rail, a locating plate having one end fixedly fastened to said inner rail; said locating plate having a fixed end fixedly fastened to a middle part of said inner rail, a free end extending out of said inner rail and terminating in an inwardly extended guide face, and two retaining notches bilaterally disposed on a middle portion of the locating plate between said fixed end and said free end; said spring fastened with said stop member to said intermediate rail, said intermediate rail having a sliding slot, said stop member comprising a downward protruding block inserted through the sliding slot of said intermediate rail, an upward side flange, a positioning block at one end remote from said stop member, the positioning block of said intermediate rail comprising two positioning flanges adapted to engage the retaining notches of said locating plate of said inner rail, said spring having a first end fixed against the downward protruding block of said stop member and a second end fixed against a part of said intermediate rail, said outer rail comprising a retaining block on a middle thereof; said retaining block comprising a smoothly arched guide portion and a stop portion adapted to stop the downward protruding block of said stop member, said second sliding bearing having a longitudinal opening, which receives said retaining block, said spring forcing the upward side flange of said stop member against one sidewall of said inner rail for enabling said intermediate rail to be moved with said inner rail when pulling said drawer out of said desk at an initial stage, said first sliding bearing being stopped by the upright front stop flange of said outer rail for allowing said inner rail to be continuously pulled outwards when pulling said drawer out of said desk, said stop member being forced by said spring to move said downward protruding block into engagement with the stop portion of said retaining block to stop outward movement of said intermediate rail for allowing said inner rail to be continuously pulled outwards with said drawer until engagement of the retaining notches of said locating plate with the positioning flanges of the positioning block, said locating plate being pressed and disengaged from the positioning flanges of said positioning block for enabling said inner rail to be moved backwards with said drawer, and said inner rail forcing said stop member away from the retaining block of said outer rail for enabling said intermediate rail to be moved with said inner rail backwards to an inside of said desk;

wherein said inner rail comprises a raised portion protruded from said one sidewall thereof adapted to engage the upward side flange of said stop member for enabling said intermediate rail to be moved with said inner rail outwards when pulling said drawer out of said desks, said raised portion of said inner rail being moved over the upward side flange of said stop member for enabling said inner rail to be pulled with said drawer out of said intermediate rail when pulling said drawer outwards by force; said inner rail, said intermediate rail, said second sliding bearing, said stop member, said first sliding bearing, and said locating plate are moved in the same direction without causing an interference when pulling said drawer out of said desk or pushing said drawer back into the inside of said desk, said downward protruding block of said stop member comprises a supporting rib bridging the sliding slot of said intermediate rail to support said stop member in position when said downward protruding block of said stop member engages the stop portion of said retaining block.

* * * * *